US005111739A

United States Patent [19]

Hall

[11] Patent Number: 5,111,739

[45] Date of Patent: May 12, 1992

[54] AIR FLOW CONTROL SYSTEM

[76] Inventor: James F. Hall, 4150 Charms Ct., Milford, Mich. 48012

[21] Appl. No.: 596,310

[22] Filed: Oct. 10, 1990

Related U.S. Application Data

[63] Continuation-in-part of Ser. No. 434,300, Nov. 13, 1989, abandoned.

[51] Int. Cl.[5] ..... F24F 7/06

[52] U.S. Cl. ..... 454/306; 454/296; 454/333; 454/903

[58] Field of Search ..... 98/40.19, 40.1, 40.11, 98/41.1, 41.2, DIG. 7

[56] References Cited

U.S. PATENT DOCUMENTS 1,592,718 7/1926 Browne ..... 98/40.18 X
2,180,173 11/1939 Share ..... 98/41.1 X
2,807,329 9/1957 Caldwell ..... 98/40.19 X

FOREIGN PATENT DOCUMENTS 673312 12/1914 Austria ..... 98/40.19
1442170 7/1976 United Kingdom ..... 98/40.11

*Primary Examiner*—Harold Joyce
*Attorney, Agent, or Firm*—Donald P. Gillette

[57] ABSTRACT

A duct to carry air has openings along it and a flexible sheet extending longitudinally within it. The end of the sheet adjacent the point of air intake can be brought against one side of the duct or the other, either to allow air to be blown through the duct along the side thereof in which the holes are located or to force the air to go through the duct along the other side, thereby not being able to emerge from those holes.

26 Claims, 5 Drawing Sheets

FIG. 6
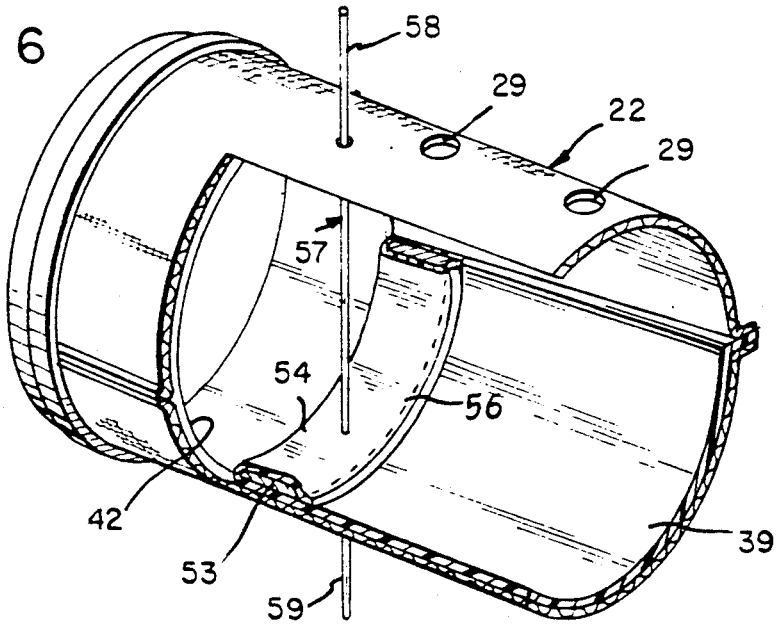
FIG. 7
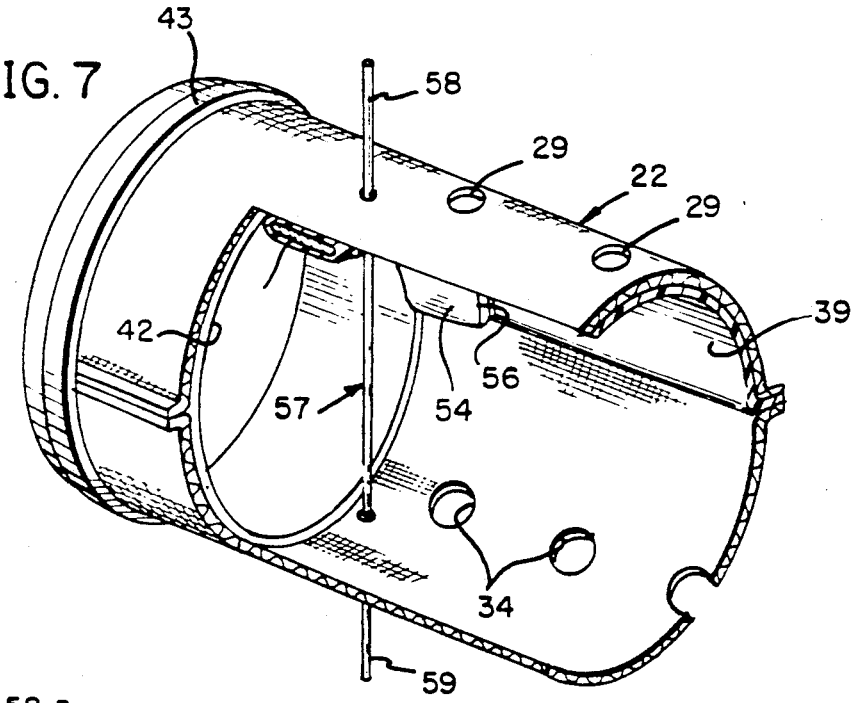
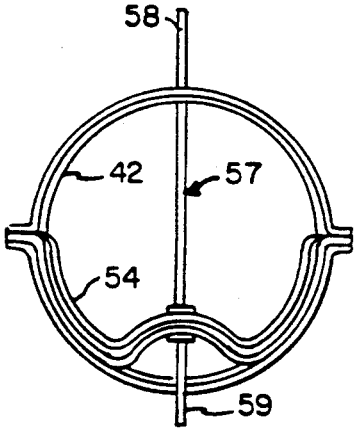
FIG. 8

AIR FLOW CONTROL SYSTEM

This is a continuation-in-part of application Ser. No. 434,300 filed Nov. 13, 1989 now abandoned.

BACKGROUND OF THE INVENTION

This invention relates to a system for controlling the flow of air through a duct, either to allow the air to escape from the duct by way of exit means along the duct or to prevent it from escaping, depending on the way internal structure in the duct is connected to a source of air. In particular, the invention relates to a duct with an interior, longitudinal, flexible sheet, opposite longitudinal edges of which are joined to the duct at lines of attachment extending along the duct.

In factories and similar buildings, it is common to remove stale and contaminated air by exhaust fans. This tends to reduce the atmospheric pressure in such structures, but the buildings are not airtight, and air seeps in by way of the many openings and crevices in the walls, doors, etc., to replace the exhausted air. In cold weather, the air entering the building in this way is likely to be experienced by people in the building as drafts and cold areas, particularly near the floor. At the same time, the manufacturing and other activity in the building, as well as radiant heat absorbed by the roof and walls, adds to any heat produced by fuel-driven heaters in the building. The density of the air is inversely proportional to its temperature, so the hotter, lighter air, however it is heated, rises to the top part of the building, further aggravating the discomfort produced by the cold drafts.

It is known that comfort in the building can be improved by deliberately bringing in air and distributing it in a controlled manner to make up for the air blown out. One way this has been done is to force the make-up air into a duct suspended just under the roof and to allow that air to escape through exit holes spaced along the duct. Such ducts are as large as 60" in diameter and as long as 550', but they may be made both larger in diameter and longer, as well as smaller and shorter. The exit holes are typically arranged in straight rows about 60° to 90° apart as measured relative to the axis of the circular duct. In order to make use of the heat in the air just under the roof, it is common to suspend the duct so that the air exit holes face upward and outward, with their axes about 30° to 45° from the vertical. This allows the make-up air to entrain and mix with air in the space near the ducts, thereby heating the emerging air and carrying it outwardly and then down to the locations in which people are working.

In the hot weather, it is not desirable to mix the incoming air with heated air just under the roof. Thus, when those in charge of the heating and ventilation of the building believe that winter has ended, it is common for them to arrange to have the duct released from its suspension means, rotated 180° on its axis, and reattached with the air exit holes pointing downward and outward. This allows the make-up air to blow down toward workers without first being heated. Conversely, when those in charge believe summer has ended, they arrange to have the duct returned to its winter position. Unhooking the duct, rotating it, and connecting it up again is a time-consuming, and therefore expensive, operation, even though the duct is typically made of fabric, which collapses to the thickness of two sheets when no air is blowing through it, and therefore, there is a tendency not to make the changeover until well after the first days of the new season have passed, which means that there are likely to be several days of discomfort before, and sometimes even after, each changeover.

OBJECTS AND SUMMARY OF THE INVENTION

It is one of the main objects of this invention to provide an air flow control system with a vented duct in which the vents can either be open or closed by an internal, longitudinal, flexible sheet blown by air in the duct that forces the sheet either away from the vents or toward them.

Another object is to provide a fabric duct with an inner sheet having its opposite, longitudinal edges attached to the duct and along lines of attachment to divide the duct into a first longitudinal compartment that has air exit holes along it and a second compartment, the sheet being flexible so that it can be blown by air directed along either the first compartment, to escape through the air exit holes, or along the second compartment to cover up and close off those holes.

Another object is to divide the duct into two, equal, longitudinal compartments by an inner, flexible sheet attached to the duct wall along two diametrically opposite lines of attachment, the width of the sheet being at least substantially equal to one-half the circumference of the duct, the duct wall defining part of the wall of at least one of the compartments having air exit means along at least part of its length and on one side of the sheet.

Still another object is to provide easy means to shift the entrance end of the inner sheet from that part of the wall defining one of the compartments to that defining the other compartment.

Yet another object is to provide a method of controlling the flow of air along a duct so that the air will either escape from the duct through holes along the duct or will blow a flexible interior sheet over those holes to prevent any air from escaping through them.

A further object is to simplify the changeover so that it can be done easily and with little or no cost at any time the comfort conditions make it desirable to do so.

A still further object is to provide a duct that has a circular cross section, and, at the same time allows easy changeover between winter and summer modes.

Further objects will be apparent from the following description in conjunction with the accompanying drawings.

In accordance with this invention, a duct that has air vent means along it is also provided with a flexible interior sheet, the opposite edges of which are joined to the duct at lines of attachment that extend along the duct. The sheet thus divides the space within the duct into first and second longitudinal compartments, and the air vent means are located in the part of the duct that defines a wall portion of the first longitudinal compartment. The width of the sheet between the lines of attachment is great enough so that the end of the sheet at the entrance end of the duct can be placed around the exit nozzle of the blower and under the end part of the duct wall defining the first compartment while the end part of the duct wall defining the second compartment is placed around the remainder of the perimeter of the nozzle. Then, if both of these end parts of the duct wall are drawn around the nozzle, air blown through the nozzle will travel through the second longitudinal compartment of the duct, and the sheet will be blown against, or at least toward, the inner surface of the part of the duct that constitutes part of the wall of the first compartment. This causes all of the air entering the duct to pass through the second compartment and be able to escape through any air exit means along that compartment.

On the other hand, if the end of the duct is removed from the nozzle and the end of the sheet changed so that it is under the end part of the duct wall that defines the second compartment, air blown into the first longitudinal compartment of the space in the duct will force the flexible sheet toward the inner surface of the wall portion defining the second compartment of the duct where, thereby closing off any air exit means in the wall of the second compartment.

Although the air vent means are spoken of as being in one part of the duct, such air vent means may comprise a set of holes, which set may or may not be arranged in a straight line and may or may not be of equal size or spaced equal distances apart. In addition, there may be a second air vent means in that portion of the duct defining the wall of the second longitudinal compartment of the space within the duct. If the air vent means in one compartment are arranged in the proper positions for summer operation and the air vent means in the other compartment are in the proper positions for winter operation, the duct system can be easily converted from summer operation to winter operation by merely changing the arrangement at the air intake means connected to a blower that forces air into the duct. The cost of changing over form winter to summer operation, or vice versa, is almost entirely eliminated. The small cost of disengaging the end of the duct from the nozzle of the housing of the blower that forces air into it, moving the inner sheet to the other side of the nozzle, and placing the end of the duct back over the nozzle is negligible in comparison with the cost of releasing the duct from all of its supports along its whole length, rotating it 180°, and connecting it back to the supports, as was formerly required.

Even that small cost of disengaging the input end of the duct and re-engaging it can be further reduced by another feature of this invention. The end of the inner sheet can be connected to means substantially congruent with the inner surface of half of the duct and movable to lie substantially against one side or the other of the duct, taking with it the end of the inner sheet. When the congruent means lies against the side of the duct forming part of the wall of the first compartment, the air from the blower will only be able to flow past the congruent means along the second compartment. When the congruent means is shifted over to lie against the part of the duct forming part of the wall of the second compartment, the entrance to the second compartment will be closed, and the air will be constrained to flow only through the first compartment.

The congruent means can be a resilient member that can be snapped from one position to the other, or it can be an arcuate member, such as half of a hoop arranged to rotate about an axis along a diameter through its end points.

BRIEF DESCRIPTION OF THE DRAWINGS

FIG. 6 is a perspective view of a part of a duct according to this invention with a fragment broken away to show interior means for shifting the inner sheet from one of its stable positions to the other.

FIG. 7 is an end view of the duct in FIG. 6 with the interior means in the alternative position to that shown in FIG. 6.

FIG. 8 is an end view of the duct in FIGS. 6 and 7 with the interior means in a configuration typical of those it can occupy in shifting from one of its stable positions to the other.

DETAILED DESCRIPTION OF THE INVENTION

Figure 1:
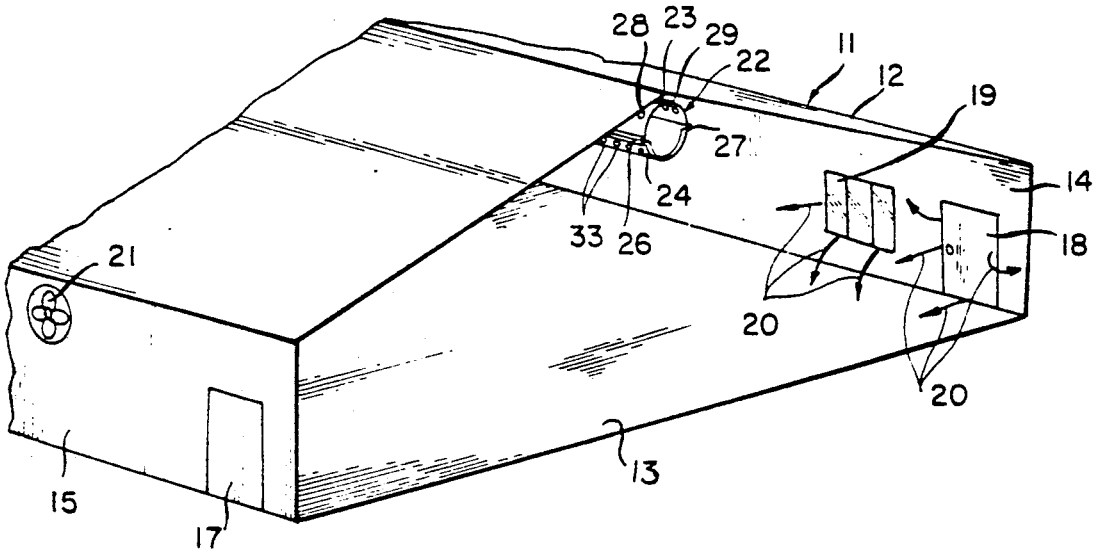
FIG. 1 is a perspective view of a part of a building with its front side removed to show an arrangement of a duct according to this invention.

FIG. 1 is a simplified drawing of a factory building 11 shown with the front wall removed. The building in this embodiment includes a gabled roof 12, a floor 13, and side walls 14 and 15 in which two doors 17 and 18 and a window 19 are visible. An exhaust fan 21 is shown in the wall 15 to remove stale and contaminated air from the building 11, and the resulting reduction of atmospheric pressure in the building causes drafts, indicated by arrows 20, to enter by way of any crevices, such as those usually found around the doors and windows. In order to overcome such drafts and to provide a more comfortable distribution of air in the building, a duct 22 is suspended just under the ridge of the roof 12. In this embodiment, the duct is a tube of flexible material, connected to a blower (not shown in FIG. 1) at one end and closed at the other end. A very satisfactory material for the duct is woven polyethylene cloth. When the blower is not operating the duct will normally hang down like a two-layer strip of cloth. It only assumes the tubular shape shown because it is inflated by the blower. However, the duct can be made of other materials, including rigid sheet material, that will cause it to retain a generally cylindrical shape even when no air is being forced into it. While the shape is referred to as generally cylindrical, it is to be understood that this is not limited to a cylinder of round cross section but includes cylinders of polygonal cross section. Moreover, the shape may be gently tapered over a long distance or reduced in diameter in steps in which the cross-sectional size changes noticeably within a short longitudinal distance.

Figure 2:
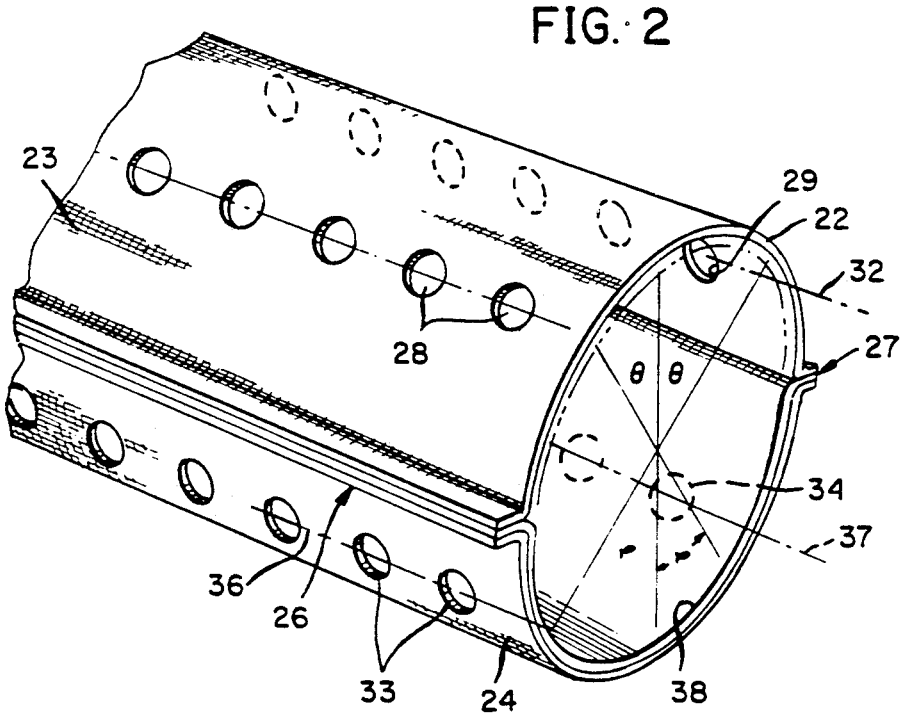
FIG. 2 shows a perspective view of a short part of the duct in FIG. 1.

A short length of the duct 22 is shown in FIG. 2 in the same inflated condition. In this embodiment, the duct is formed of strips of woven material 23 and 24 joined together along seams 26 and 27 on diametrically opposite sides of the duct. In FIG. 2, the seams are shown as lying in the same horizontal plane. Only two strips are shown in this embodiment, but more strips can be used to make a duct of larger diameter. The strip 23 that forms the upper half of the duct 22 has air vent means, which, in this embodiment, are arranged in the form of two sets of holes 28 and 29 symmetrically spaced on opposite sides of an imaginary vertical plane through the axis of the duct 22. The location of the holes 28 is represented by a row 31 defined by a line through their centers, and this line is offset from the vertical plane by an angle $\theta$, which is preferably between about 30° and 45° but can be any number of degrees to accommodate ventilation requirements. A row 32 defined by a line through the center of the holes 29 is symmetrically displaced on the other side of the vertical plane so that the total angle between the rows 31 and 32, as measured relative to the axis of the duct 22 is between about 60° and 90°.

The strip of material 24 that forms the lower half of the duct also has two sets of holes 33 and 34, the center lines of which define two rows 36 and 37 displaced by angles of $+$ and $-\phi$ relative to the vertical plane. Preferably, the angle $\phi$ is of about the same angular measure as the angle $\theta$, so that the total angle between the lines 36 and 37 is also between about 60° and 90°. However, the sets of holes 33 and 34 can be dispersed in any desired arrangement, as can the holes 28 and 29.

Heretofore, ducts like the duct 22 have only had two rows of holes, similar to either the rows 31 and 32 or the rows 36 and 37. The purpose of these holes was to direct air from the duct out to the space adjacent the duct and in the proper direction to make the working space in the factory more comfortable. In the winter it was the practice to suspend the duct so that the holes were in the positions of the holes 28 and 29 to direct air outward and somewhat upward into the space near the roof of the building. The air in the duct in the winter was relatively cool air brought in from the outdoors, although it may have been heated to some extent before it entered the duct 22. By being directed somewhat upward, this incoming air mixed with the relatively stationary heated air that accumulated just under the roof of the building. The continued force of air through the holes 28 and 29 eventually forced the mixed air down into the working area, increasing the comfort of the workers without requiring any expenditure for additional fuel to increase the workers' comfort.

In the summertime, it was not desireable to heat the incoming air, called make-up air, which only replaced air expelled from the building by the exhaust fan or fans. In order to direct the incoming air downward rather than upward, it was the practice to detach the duct from its suspension means, rotate it 180° on its axis, and connect it back again to the suspension means. This made it necessary only to provide two rows of holes, such as the holes 33 and 34, but the cost for the labor required to detach, rotate, and reattach the duct was considerable. This task, which formerly had to be done in the spring and fall, has been rendered unnecessary by the present invention.

FIG. 2 shows an extra sheet 38 of flexible material joined to the wall of the duct 22 along the seams 26 and 27, which form lines of attachment between the edges of the sheet 38 and the duct and, in this embodiment, are not only diametrically opposite each other but are in a common horizontal plane. The width of the sheet 38 is at least substantially as great as the circumferential distance between the lines of attachment, i.e., one-half the total circumference of the duct. In fact, it is desirable that the sheet be slightly wider, for example, about ¼" wider, than it would need to be to lie precisely congruent with the inner surface of the inner wall of the duct 22. Making the sheet a little wider assures that the sheet 38 will, in fact, contact substantially the entire surface area of the part of the duct wall in which one set of the holes lies, i.e., the set comprising the holes 33 and 34. By doing so, the sheet 38 closes off these holes and allows air in the duct 22 to escape only by way of the holes 28 and 29, which direct the air upward and outward. This is the proper direction for the air from the duct to move in the wintertime. Since the sheet blown against the inner surface of the duct 22 is supported by the duct, it is not necessary for the sheet 38 to be as strong as the material used for the duct, itself; a thinner, lighter material can be used for the sheet, which makes it easier to be moved from one of its alternative positions to the other.

Figure 3:
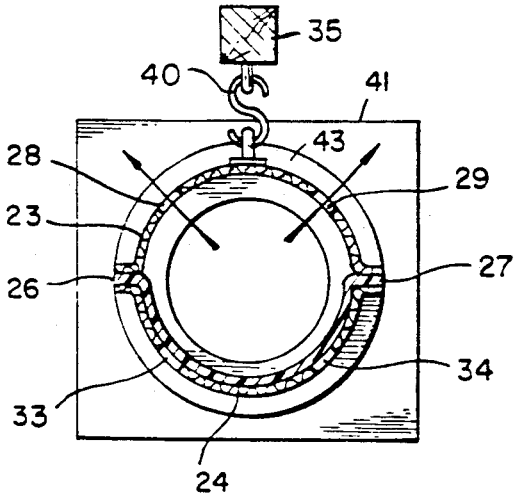
FIG. 3 is a cross-sectional view of the duct in FIG. 1 under one operating condition.

The sheet 38 does not simply lie on the surface of the strip 24 by virtue of the weight of the sheet. In FIG. 2, it is forced down by the pressure of the air in the duct 22, the same pressure that inflates the duct and forces air out through the air vent holes 28 and 29. FIG. 3 is a cross-sectional view of the duct 22 looking toward a fan, or blower, 41 that supplies air to it. The blower has a large nozzle 42, the outer diameter of which is substantially equal to the inner diameter of the duct. In order to have the sheet 38 lie against the bottom strip 24 and close off the holes 33 and 34, the end of the sheet is fitted under the nozzle of the blower, and the whole end of the duct is joined relatively air-tight to the nozzle 42 by means of a strap 43 to achieve the same type of fitting action achieved by a hose clamp on a small hose. When the duct 22 is so connected to the nozzle, all of the air forced into the duct by the blower 41 flows between the sheet 38 and the top strip 23.

Figure 4:
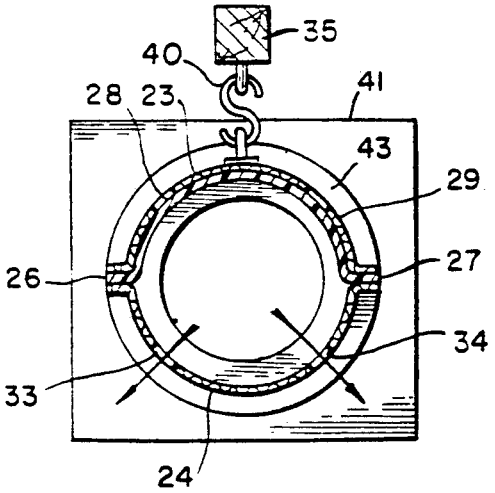
FIG. 4 shows a cross-sectional view of the duct in FIG. 1 under a second operating condition.

FIG. 4 shows the alternative way of fitting the end of the duct 22 onto the nozzle 42 for warm weather operation. The sheet 38 is fitted on the upper part of the perimeter of the nozzle 42 so that, as the air from the blower 41 flows into the duct, it lifts the sheet 38 up against the upper strip 23 and seals off the holes 28 and 29. At the same time, the holes 33 and 34 are uncovered, allowing air to exit through them in a direction outward and downward from the duct 22. This air mingles little, if at all, with the stratified air just under the roof, where the duct is located, and so it picks up little heat from that stratified air. The duct is shown supported from a beam 35 by hooks 40, but any suitable means of support may be used instead.

It is an important advantage of this invention that the changeover from the position of the sheet 38 in FIG. 3 to that in FIG. 4 requires nothing more difficult than disconnecting and reconnecting the end of the duct 22 attached to the blower nozzle 42. The rest of the duct need not be touched. In particular, it is not necessary to release the whole duct from its supporting means so as to allow it to be lowered and then lifted again after having been rotated on its axis to change the direction of outflow of air through the openings along the duct.

The sheet 38 can be attached to the duct 22 in any convenient way, such as by stitching, gluing, riveting, clamping, or stapling the sheet to one or both of the strips 23 and 24 forming the duct. Furthermore, the size of the duct may make it possible to form it out of a single strip of material or may dictate that more than two strips be used. All of these factors are details of production and not limitations on the invention. Moreover, the seams 26 and 27 are shown as being in a horizontal plane, but there may be occasions when the lines of attachment of the sheet 38 to the duct should be in some other plane. The sheet is, in essence, a valve that closes one air exit means as it opens another, but it could be used merely to open or close a single air exit means. It is also not necessary that the air vent holes be arranged in straight lines or that the holes be symmetrically placed about either a vertical or a horizontal central plane. For example, if the duct is run along an intersection between a vertical wall and a ceiling, all of the same holes, both for winter and summer operation, may be on the same side of a central vertical plane so that none of the air is directed toward the vertical wall.

While the arrangement illustrated in FIGS. 1-4 is particularly convenient for switching between cold weather and hot weather operation, there may be other reasons for controlling the flow of air according to the system of this invention. Furthermore, although there are likely to be two sets of air-exit holes, one for summer operation and the other for winter operation, along the entire length of the duct, it may be that, for some part of the duct, no air-exit holes are needed, or they are needed for only one part of the year. That part of the duct can be provided with only such holes as are necessary. In all cases, the sizes and locations of the holes will be determined by the ventilation requirements of the building and the air flow capabilities of the duct system.

Figure 5:
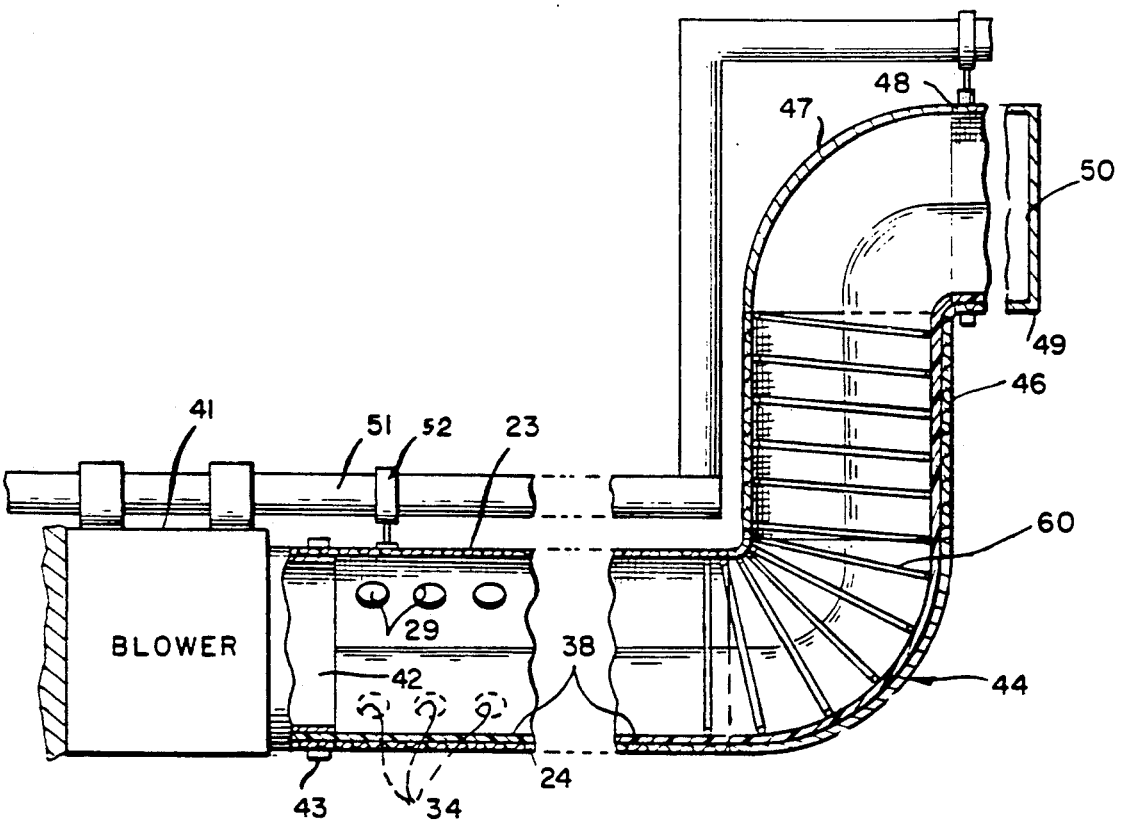
FIG. 5 shows a side view, partly in cross-section, of a duct system according to this invention.

FIG. 5 shows a duct system similar to those described in FIGS. 1-4 arranged for use in a building having different roof levels. One end of the duct 22 is shown attached to the blower 41 from which the duct extends some distance on one level to a bend, or elbow, 44. An extension 46 of the duct goes up to a second bend 47 at a second level and then a further extension 48 continues out on that level to the end 49 remote from the blower 41, where it is closed, in this instance by a panel 50, as is typical of duct systems. There may be several bends, up, down, or lateral, in a duct system. The inner sheet 38 must continue along the entire duct, if the switchover from one mode to the other along the entire duct is to be controlled by shifting only the entrance end of the sheet 38. In such a case, the sheet 38 must continue even through such parts of the total system as the elbows and the section 46, where there are no openings.

The elbows may be located anywhere in the duct system, except for the first part adjacent the blower 41; I have found it preferable to have the duct 22 extend straight for a distance at least equal to about 2½ times its diameter before it reaches a bend, or elbow. The blower is shown supported by brackets 49 attached to a beam 51, although it is to be understood that this is only illustrative and that the blower can be supported in any secure manner. Similarly, the duct sections are shown suspended from the beam 51 by hangers 52 but may be supported by other means.

Although disconnecting the entrance end of the duct 22 from the nozzle 42, reversing the position of that end of the inner sheet 38 and reconnecting the duct to the nozzle, as has been described in connection with FIGS. 3 and 4, is not very time-consuming, FIGS. 6-8 show an even easier way to make the changeover. A member 53 is attached to the entrance end of the sheet 38 and is arranged to lie so as to be substantially congruent with the inner surface of the duct, or, more specifically, with the inner surface of one-half of the duct 22. This member 53 is connected to means to shift it from the position in FIG. 6 to the alternative position in FIG. 7, thereby carrying with it the end of the sheet 38.

In the embodiment illustrated in FIGS. 6-8, the member 53 is a resilient strap attached to the sheet 38 by being sewn into a pocket 54 formed in the end of the sheet by reversing the end of the material and sewing it along a seam 56. It is preferable that the pocket and the strap 53 lie outside the nozzle 42 where the duct 22 bulges slightly and the pocket and strap are out of the main stream of air as it emerges from the nozzle. This also makes it unnecessary to cut the length of the strap so that it lies exactly congruent with the nozzle 42. FIG. 8 shows the pocket 54 that encloses strap 53 in an unstable flexing position typical of the way it is likely to bend in shifting from the position shown in FIG. 6 to that shown in FIG. 7.

The means 57 for moving the strap 53 from one of its stable positions to the other can be simply a rope or cable tied to the center of the strap or to the top and bottom of the duct 22, directly over and under the pocket. By pulling on the upper end of the cable 57, the pocket 54 and the strap 53 in it can be pulled up to be congruent with the upper part of the duct wall. Then, pulling on the lower end 59 of the cable causes the strap to snap down to its lower position in an over-center action. The changeover from one mode, such as the winter mode, of operation of the duct system to the other mode, e.g., the summer mode, by this means is so easy that it can be carried out to accommodate even a short-term change in the ventilation requirements.

While the duct 22, including the sections 46 and 48 in FIG. 5, for example, has the same circular cross-section from end to end, it is not necessary that the cross-sections be circular or that they all be the same size. Cylinders can have any cross-sectional shape, including both rounded and polygonal, and that is true of the duct 22 and its various sections, however many of them there are. In the case of polygonal ducts, it may be particularly desirable to make them of rigid sheet material, such as the galvanized steel or aluminum frequently used for ducts. Or the duct could be made of rigid sheet plastic material. As a further alternative, the wall of the duct could be made of flexible material, as stated hereinabove, but a large diameter coil 60 of reinforcing wire could be joined to the flexible material so that the duct would retain its shape at all times and not go limp when the blower was turned off.

The diameter could change from the blower end to the remote end (or ends, if the duct system is divided into branches) and the change could be gradual, making the duct 22 slightly tapered, or it could change relatively abruptly, so that it consisted of sections having uniform cross-sectional area, each joined, at its end more remote from the blower 41 by a relatively sharp tapering section to another cylindrical section of uniform, or relatively uniform, cross-sectional area.

Figure 9:
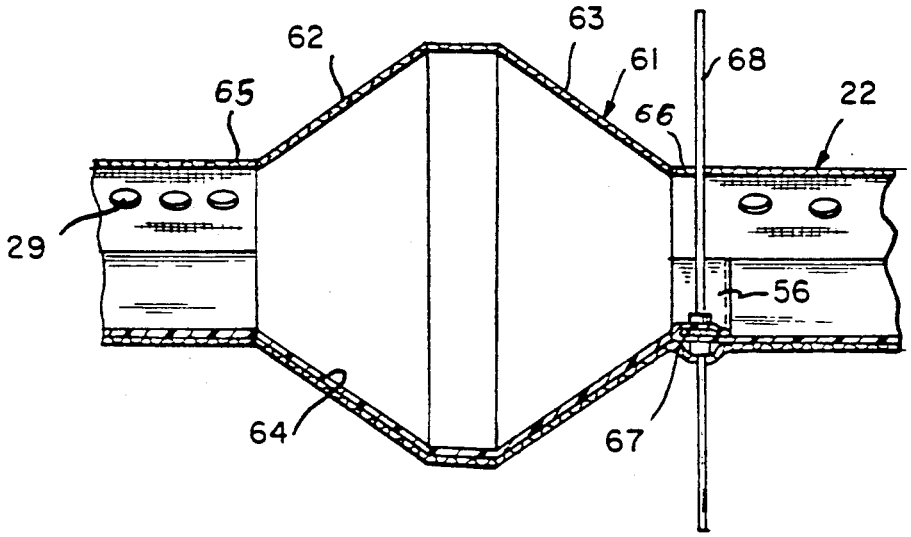
FIG. 9 is a cross-sectional side view of a fragment of duct having means for summer and winter operation according to this invention but modified to pass through a narrow opening.
Figure 10:
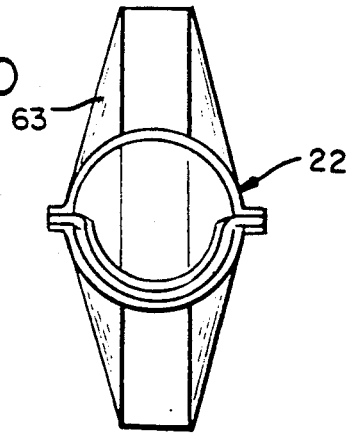
FIG. 10 is an end view of the fragment of the duct in FIG. 11.

For example, in order to pass through a space of restricted height or width, the cross-sectional shape of at least a part 61 of the duct 22 may be modified accordingly, as shown in FIGS. 9 and 10, and connected by tapering sections 62 and 63 to other parts 64 and 66 of the duct 22 on each side of the narrow part. The sections 61-63 all should be formed to maintain a constant cross-sectional area so as not to constrict the flow of air through the system. A flexible, inner sheet 65 of suitable shape may be attached to the sections 66 and 63 to allow the changeover between winter to summer modes to take place downstream of these sections, although a member 67 similar to the member 53 can be used in the section 66 downstream of the sections 61-63. The member 67 can be controlled in the same way as the member 53 but by a separate cable 68 or other means. With a separate control for switching mode at different points along the duct system, it is not necessary that a single sheet 38 extend the full length of the system. There does not need to be a sheet equivalent to the sheet at locations where no change need be made between the winter and summer modes. Instead, a separate inner sheet can be placed an any part of the duct system downstream of such a location and controlled separately from the control at the head end, as is done by the cable 68.

Figure 11:
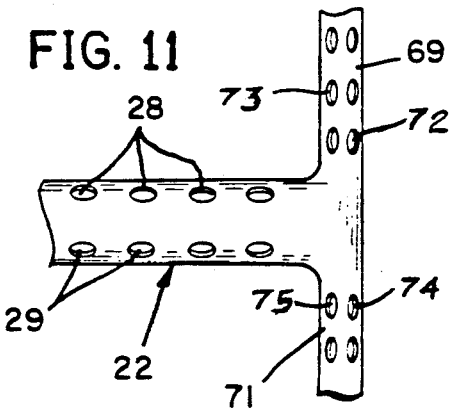
FIG. 11 shows a branched duct system utilizing the mode control features of this invention.

Still another possible configuration of a duct system making use of this invention is shown in FIG. 11, which is a view of the duct system from above and shows a main duct 22 divided into two (or more) branch ducts 69 and 71. It will be noted that the diameter of each of the branches has a smaller diameter than that of the main duct 22. The cross-sectional areas of the branches 69 and 71 should be calculated to be the proper fractions of the area of the duct 22 to maintain proper air flow. The duct 69 has the same arrangement of air exits 72 and 73 as the air exits 28 and 29 in the duct 22, although the exits 72 and 73 may not be the same size as the exits 28 and 29 and may be spaced differently. The duct 69 also has downwardly directed air exits similar to the exits 33 and 34 in FIG. 2, but the downwardly directed air exits in duct 69 are not visible in this view shown. The duct 71 in this embodiment is similar to the duct 69, except that the duct 71 is slightly tapered so that is cross-sectional area decreases with increasing distance from the junction of the ducts 22, 69, and 71. The taper of the duct 71 is much more gradual than the taper of the duct 22 at the place where it joins the ducts 69 and 71. Like the duct 69, the duct 71 has both upwardly and downwardly facing air exits, and only the upwardly facing air exits 74 and 75 are visible in this figure.

Figure 12:
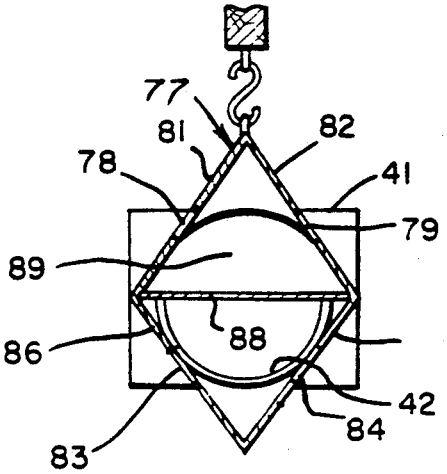
FIG. 12 is a cross-sectional view of a modified duct with winter and summer mode capabilities.

FIG. 12 shows a cross-sectional view, looking toward the blower 41, of a polygonal duct 77. In this case, the cross section is diamond-shaped. This duct is made of thin, stiff material, such as sheet metal or plastic, but it could be made of cloth or other flexible material, like the duct in FIG. 2. However, if the duct 77 were made of flexible material, the air that expands it from its limp condition would cause its sides to be somewhat bulbous rather than flat like the sides of the duct 77. As in the case of the duct 22, the duct 77 is formed with air exits 78 and 79 in the sides 81 and 82, respectively, and air exits 83 and 84 in the sides 86 and 87. The duct 77 is suspended so that the sides 81 and 82 face upwardly and outwardly and the sides 86 and 87 face downwardly and outwardly. Thus, the air exits 78 and 79 are positioned for winter operation and the air exits 83 and 84 are positioned for the summer mode of operation. Air entering the duct is directed either to the upper or lower part of the duct by a central sheet 88. In FIG. 12, the end of the duct 77 is modified from a diamond shape to a round shape to conform to the nozzle 42, and the end 89 of the sheet 88 adjacent the blower 41 covers the upper part of the nozzle 42 to force all of the air from the blower to pass through the lower part of the duct 77 and out through the summer mode air exits 83 and 84. The duct 77 is large enough so that primarily only the upper part or primarily only the lower part need be used at any one time. Thus, the sheet 88 need not be flexible.

Figure 13:
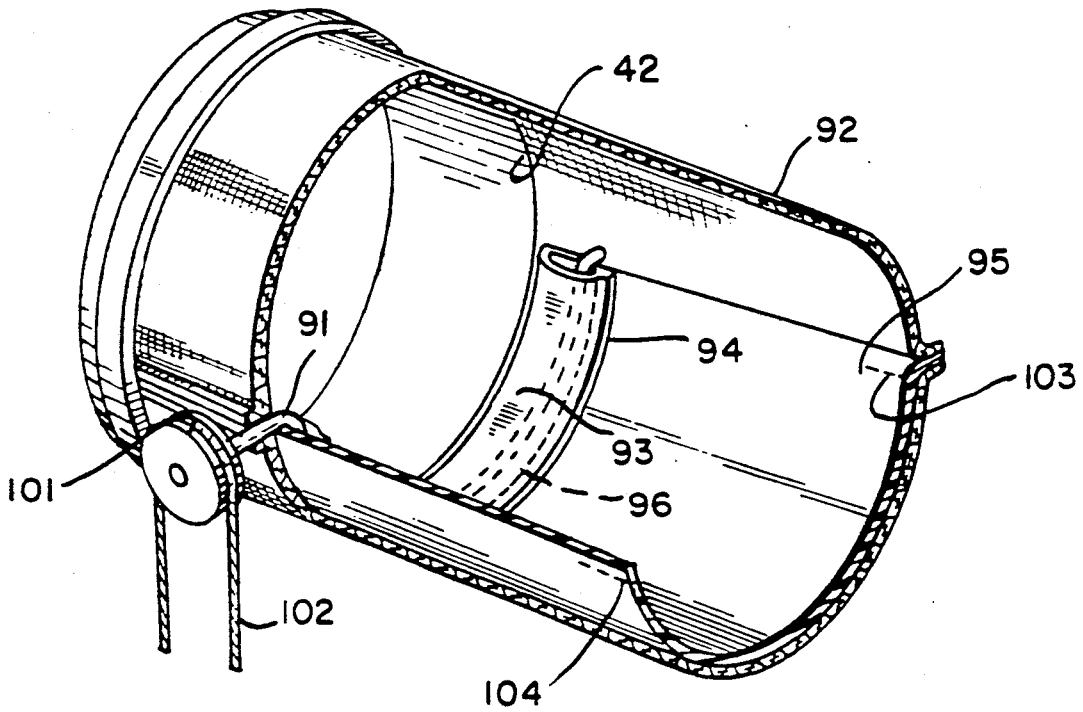
FIG. 13 is a perspective view of a part of a duct according to this invention with a fragment broken away to show a pivotally mounted bowed rod for shifting the inner sheet from one of its stable positions to the other.
Figure 14:
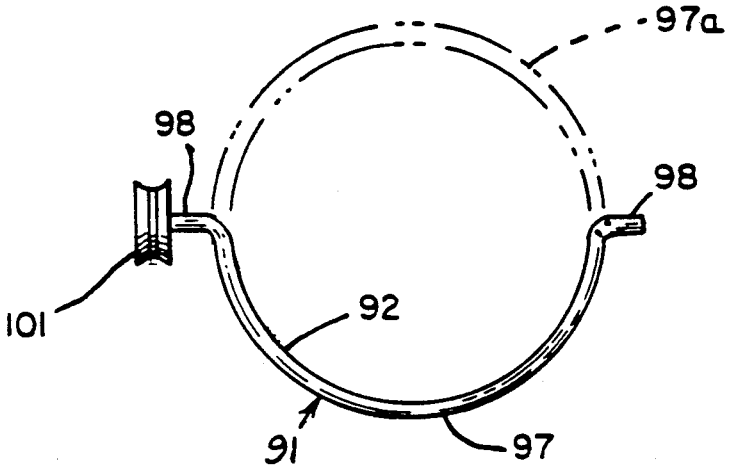
FIG. 14 shows the bowed rod of FIG. 13.

FIGS. 13 and 14 show an alternative embodiment for changing modes. In this embodiment, a metal rod 91, preferably of round cross section and smooth surface, is sewn into a pocket 93 formed at the end 94 of a sheet 95 similar to the sheet 38 in the prior figures. The pocket may be formed by folding the end of the sheet 95 back over the rod and sewing a seam 96 to hold the folded end in place.

The rod has, in this embodiment, a circularly curved main portion 97 bent along an arc that corresponds closely to the circular cross section of the duct 92. Preferably, the arc is 180°, and the ends 98 and 99 are bent out in opposite directions along a line that is an extension of a diameter of the circle of which the rod forms a 180° arc. This enables the ends 98 and 99 to serve as axles about which the main portion 97 can be rotated approximately 180° from the position shown in solid lines in FIG. 14 to the position **97*a* shown in broken lines. The end 98 is shown as having a pulley 101 firmly attached to it to effect such rotation of the rod, although it is not necessary to have a complete pulley, particularly if the rotation need not be a full 180° between the positions 97 and 97*a*; a transverse rod attached to or formed at the outer part of the end 98** may be sufficient.

In FIG. 13, the ends 98 and 99 are shown extending through opposite sides of the duct 92 to be journaled therein or in an end part of the nozzle 42. Rotation of the rod from the position in which it is illustrated to the alternative position corresponding to the position **97*a* can be effected by rotating the pulley 101 by a rope or chain 102 looped over it and hanging down far enough to be grasped by a workman. Such a rope and pulley is only necessary if the end 98** is out of reach of a person seeking to switch the mode of operation of the duct over from summer to winter or vice versa.

It is to be noted that the sheet 95 is not sewn to the duct 92 all the way to the end of the sheet, as is typically done in the previous embodiments. Instead, lines of stitches 103 and 104 stop far enough from the end 94 to allow the entire end portion of the sheet to swing from being congruent with one side (the lower side) of the duct to being congruent with the other side (the upper side). In one position, the sheet directs air from the nozzle 42 along the upper longitudinal compartment of the duct for winter operation, and in the other position, the sheet directs air along the lower longitudinal compartment for summer operation. Switching from either mode to the other is simply a matter of pulling on the correct side of the rope.

While this invention had been described in terms of specific embodiments, it will be recognized by those skilled in the art that modifications may be made therein within the true scope of the invention.

What is claimed is:

1. An air flow control system comprising:

(a) an elongated, cylindrical, flexible duct having a set of air exit holes along the duct;

(b) a flexible liner sheet within the duct and extending longitudinally along the duct; and (c) means defining first and second lines of attachment attaching opposite longitudinal edges of the sheet to the duct to divide the interior space in the duct into first and second longitudinal compartments with the air exit holes being in a first portion of the duct on one side of the sheet and in the first compartment, the width of the sheet between the lines of attachment being at least substantially equal to the inner circumferential dimension of the duct between the lines of attachment, whereby air can be directed longitudinally along the first longitudinal compartment to escape through the air exit holes or along the second longitudinal compartment to force the sheet against the inner surface of the portion of the duct wall containing the air exit holes to block those holes.

2. The air flow control system of claim 1 in which the air exit holes are substantially in a straight row along a substantial part of the length of the duct.

3. The air flow control system of claim 1 in which the set of air exit holes comprises first and second rows of holes.

4. The air flow control system of claim 1 in which the lines of attachment are in substantially the same horizontal plane.

5. The air flow control system of claim 1 in which the lines of attachment are substantially diametrically opposite each other.

6. The air flow control system of claim 1 in which there is a second set of air exit holes along the duct in the part thereof forming a wall of the second longitudinal compartment.

7. The air flow control system of claim 6 in which each set of air exit holes comprises a plurality of substantially parallel rows of air exit holes.

8. The air flow control system of claim 1 in which the duct comprises:

(a) a plurality of straight parts; and (b) at least one bend between each pair of the straight parts, the liner sheet extending through each of the bends and each of the straight parts.

9. The air flow control system of claim 8 comprising attachment means to attach one end of a first one of the straight parts of the duct and a corresponding end of the liner sheet to a fan, said first one of the straight parts having a length from said one end thereof to the first one of the bends at least 2½ times as great as the diameter of the first one of the straight parts.

10. The air flow control system of claim 1 in which the duct and the flexible sheet are made of woven fabric material.

11. An air flow control system comprising:

(a) an elongated duct having an air input end and air exit means along the duct; and (b) flexible sheet means within the duct and extending longitudinally along the duct, spaced-apart regions of the sheet means being attached to the duct along first and second lines of attachment extending generally longitudinally along the duct to divide the interior space of the duct into first and second longitudinal compartments with the air exit means being on one side of the sheet means and in the portion of the duct defining part of the boundary of the first compartment, whereby air can be directed either through the first longitudinal compartment to force the sheet means away from the portion of the duct defining part of the boundary of the first compartment to allow the air to escape through the air exit means or longitudinally through the second longitudinal compartment to force the sheet means toward the inner surface of said portion of the duct to block passage of air through the air exit means.

12. The air flow control system of claim 11 further comprising second air exit means in the portion of the duct defining a part of the wall of the second longitudinal compartment.

13. The air flow control system of claim 11 in which the duct is made of woven material of a predetermined thickness and the flexible sheet means is made of material of lesser thickness than the duct.

14. The air flow control system of claim 11 comprising guide means connected to the flexible sheet means adjacent the air input end and movable from a position adjacent one side of the duct to a position adjacent the other side of the duct to direct the air along either the first compartment or the second compartment, respectively.

15. The air flow control system of claim 11 in which the guide means connected to the flexible sheet means adjacent the air input end moves that end of the flexible sheet means from a first position substantially congruent with one side of the duct to a second position substantially congruent with the other side of the duct to direct the air along either the first compartment or the second compartment, respectively.

16. The air flow control system of claim 15 in which the guide means comprises resilient means extending across the width of the flexible sheet means and joined thereto, the length of the resilient means in the direction parallel to the width of the sheet means being substantially equal to one-half the circumference of the duct.

17. The air flow control system of claim 15 in which the guide means comprises a bowed rod pivotally attached at opposite sides of the duct to pivot between first and second positions on a pivot axis transverse with respect to the longitudinal dimension of the duct, and a longitudinal end portion of the flexible sheet means is attached to the rod to be moved from a location adjacent one side of the duct when the rod is pivoted to the first position to a location adjacent the other side of the duct when the rod is pivoted to the second position.

18. The air flow control system of claim 17 in which the rod has an arcuate length at least approximately equal to one-half of the circumference of the duct at the location of the pivot axis.

19. The air flow control system of claim 18 in which one end of the rod extends through the wall of the duct, and the system comprises rotational drive means attached to the one end of the rod to pivot the rod about the pivot axis.

20. The air flow control system of claim 11 in which the duct has at least one bend in it, and the lines of attachment continue through the bend.

21. The air flow control system of claim 20 in which the duct comprises a first end to be fitted around a blower nozzle to receive air therefrom, and the duct extends straight from the first end for a distance of at least 2½times the diameter of the duct.

22. The air flow control system of claim 11 comprising:

(a) a blower having a nozzle;

(b) means to secure one end of the portion of the sheet, together with the corresponding end of the part of the duct that forms one end of the first longitudinal compartment, around one part of the perimeter of the nozzle, and the corresponding end of the portion of the duct that defines the corresponding end of the second compartment around the opposite part of the perimeter of the nozzle, whereby substantially all air from the blower is directed through the first compartment.

23. The air flow control system of claim 22 in which the air exit means comprise rows of exit holes, the rows being on opposite sides of a vertical plane through the center of the duct, the duct further comprising additional rows of exit holes on opposite sides of the vertical plane and below the substantially horizontal plane, the width of the flexible sheet means between the lines of attachment being at least as great as one-half of the circumference of the duct.

24. The method of controlling the flow of air through air exit holes spaced along an elongated duct that includes a flexible inner sheet, opposite longitudinal edges of which are attached to the duct along lines of attachment extending longitudinally along the duct, the air exit holes being located in a portion of the duct on one side of the sheet, said method comprising the steps of:

(a) fitting one end of the duct substantially airtight over the nozzle of a blower;

(b) causing air from the blower to blow through the duct; and (c) either (i) placing the corresponding end of the sheet on the same side of the perimeter of the nozzle as the air exit holes to prevent air from exiting through the holes, or (ii) placing the corresponding end of the sheet on the opposite side of the perimeter of the nozzle from the air exit holes to allow air from the blower to exit through the air exit holes.

25. The method of claim 24 comprising the subsequent step of shifting the end of the sheet from one size of the perimeter of the nozzle to the other to cause the air from the blower to shift the sheet from one side of the duct to the other side of the duct.

26. The method of claim 25 in which the end of the sheet is resiliently forced toward one side of the duct or the other side of the duct.

* * * * *